United States Patent [19]

Orentreich

[11] 4,112,040

[45] Sep. 5, 1978

[54] METHOD OF MAKING FIBERS CONTAINING HAIR PARTICLES

[76] Inventor: Norman Orentreich, 140 E. 72nd St., New York, N.Y. 10021

[21] Appl. No.: 789,577

[22] Filed: Apr. 21, 1977

Related U.S. Application Data

[63] Continuation-in-part of Ser. No. 720,831, Sep. 7, 1976, abandoned.

[51] Int. Cl.[2] ..... B29F 3/00; B29B 1/00; B29B 1/12

[52] U.S. Cl. ..... 264/176 F; 83/15; 241/23; 241/DIG. 37; 260/37 R; 260/37 EP; 260/37 N; 260/37 SB; 264/243

[58] Field of Search ..... 264/176 F, 243; 260/37 R, 37 N, 6, 37 EP, 37 B; 83/15; 241/DIG. 37, 23, 65

[56] References Cited

U.S. PATENT DOCUMENTS

| | | | |
|---|---|---|---|
| 2,895,173 | 7/1959 | Atticks | 260/37 EP |
| 3,279,974 | 10/1966 | Twilley et al. | 260/37 N |
| 3,503,919 | 3/1970 | Cadus | 260/37 R |
| 3,658,259 | 4/1972 | Ledergerber | 241/23 |

OTHER PUBLICATIONS

Anon., Modern Plastics Encyc., McGraw-Hill, N.Y., Sep. 1965, vol. 43, 1A, p. 595

*Primary Examiner*—Willard E. Hoag
*Attorney, Agent, or Firm*—Hopgood, Calimafde, Kalil, Blaustein & Lieberman

[57] ABSTRACT

Method of making fibers suitable for making a hair brush includes a matrix or pad made of a flexible material and a plurality of relatively rigid, single natural-type bristles having their lower ends anchored by flexible, sleevelike members projecting upward from the matrix. Also disclosed is a method of forming the bristles which includes comminuting natural bristles at a low temperature and then forming a thick slurry of the comminuted bristles and a binder, which is then molded and cured to form bristles having improved characteristics.

11 Claims, 4 Drawing Figures

METHOD OF MAKING FIBERS CONTAINING HAIR PARTICLES

The present application is a continuation-in-part of application Ser. No. 720,831, filed Sept. 7, 1976, now abandoned.

The present invention relates generally to brushes, and more specifically to natural-type bristles for use in hair brushes or the like.

The advantages of the use of natural bristles in a hair brush, rather than synthetic material, have long been recognized. Perhaps the most important of these advantages is that brushing with natural bristles does not create static electricity, which, in turn, often makes it difficult to control the hair. Natural bristles are also gentler and produce less wear on the user's hair as compared to synthetic bristles.

Natural bristles are, however, relatively brittle, such that when single natural bristles are embedded in the back of a conventional hair brush, they tend to break off at the point at which they emerge from the back as the brush is passed through the user's hair.

To prevent the natural bristles from breaking off from a conventional brush during use, the bristles are commonly incorporated into the brush in tufts or bunches. While this construction significantly reduces the likelihood that the bristles will break off from the brush, it has the disadvantage of causing the bristles to cling onto individual hairs during brushing, thereby causing the premature removal of hair from the user's scalp.

It is, therefore, an object of the present invention to provide an improved hair brush having the advantages of natural bristles.

It is another object of the invention to provide bristles for use in a hair brush or the like which produces a minimal amount of static electricity and damage to the user's hair.

It is still a further object of the invention to provide a method of forming natural-type bristles for use in a hair brush or the like which has the nonstatic properties of natural bristles, but which is far less brittle than natural bristles.

To these ends, the present invention provides a hair brush in which a plurality of individual natural-type bristles are arranged in a flexible pad or matrix which, in turn, is secured to a rigid back member. The bristles are anchored to the matrix by a plurality of flexible, sleeve-like projections that extend upward from the surface of the flexible matrix and enclose the lower ends of the bristles. The natural-type bristles are fabricated by comminuting natural hair at a low temperature into fine particles. Those particles are mixed with a binder and formed into a thick paste or slurry which is then pressure extruded in a mold and then cured to form natural-type hair bristles. The bristles fabricated in this manner have been found to exhibit the non-static feature of natural hair, while being far less brittle than natural hair bristles, and are thus highly suitable for use in a hair brush or the like.

To the accomplishment of the above and other objects as may hereinafter appear, the present invention relates to a hair brush and a method for fabricating bristles for use in a hair brush substantially as defined in the appended claims and as described in the following specification as considered with the accompanying drawing, in which:

Figure 1:
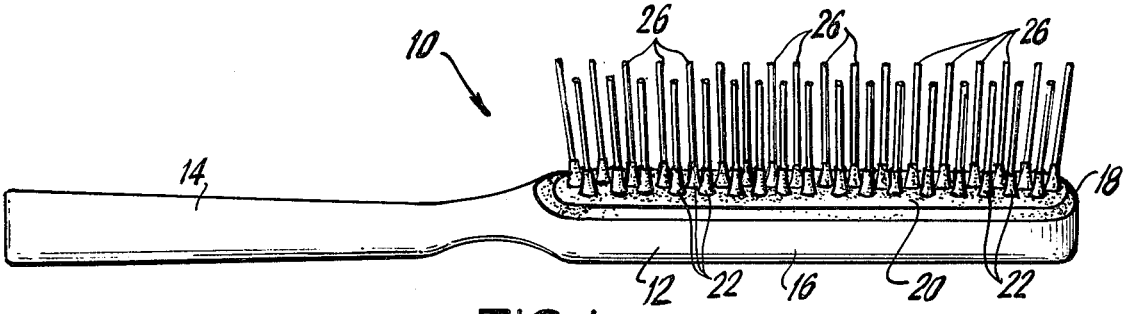
FIG. 1 is a perspective view of a hair brush according to the invention.
Figure 2:
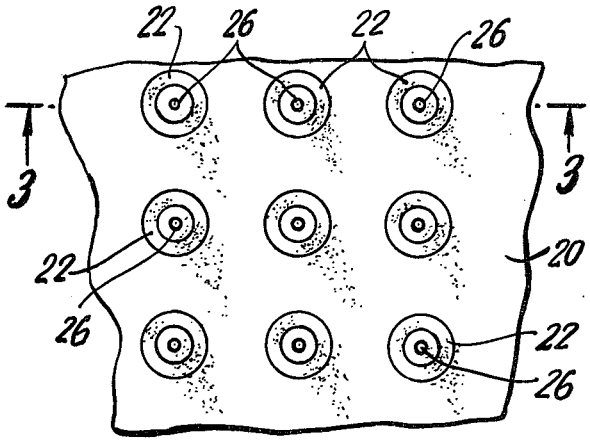
FIG. 2 is a plan view, on an enlarged scale as compared to FIG. 1, of a portion of the brush.
Figure 3:
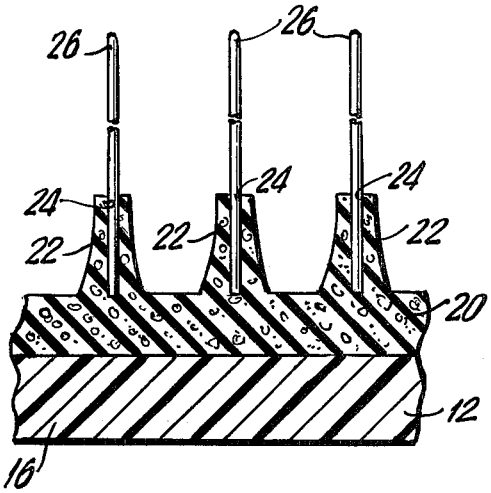
FIG. 3 is a cross-section taken across the lines 3—3 in FIG. 2.

Referring now to the figures, there is shown in FIG. 1 a hair brush, generally designated 10, which has a body portion 12 made of a suitable rigid material such as wood or a plastic material. Body portion 12, as is conventional, includes a narrow handle 14 and a wider back portion 16. Back portion 16 may include a peripheral flange 18 which defines a recess into which a pad or matrix 20 is inserted. Matrix 20 is secured by a suitable means, such as an adhesive, to the back portion 16.

Matrix 20 is made of a material which is relatively flexible and resilient as compared to that of back portion 16. Suitable flexible materials from which matrix 20 can be fabricated include foam rubber or a foam plastic.

At each location on the matrix at which a bristle is to be provided, a tapering frusto-conical anchoring member 22 of the same flexible material as that of matrix 20 projects upward from the surface of the matrix. Each anchoring member 22 has an axial opening 24 formed therethrough which receives the lower end of a single natural bristle 26, which may be, for example, made of horsehair or boar's hair. The ends of the bristles 26 received in the openings of anchoring members 22 are secured therein by a suitable means, such as the use of an adhesive.

The retention or anchoring of the lower ends of the single natural bristles in the flexible material of matrix 20 imparts a degree of flexibility to the relatively rigid bristles such that as the bristles are passed through the user's hair, the bending forces acting on the bristles, which in the conventional natural bristle brush would cause the bristles to break off from the brush, are absorbed by the flexible matrix and anchoring members before the breaking point of the individual bristles is reached.

Also provided by the present invention is a method for fabricating natural-type hair bristles which may be used to advantage in the brush described. These bristles exhibit the static-free characteristic of natural hair and are also characterized by resistance to breakage.

Figure 4:
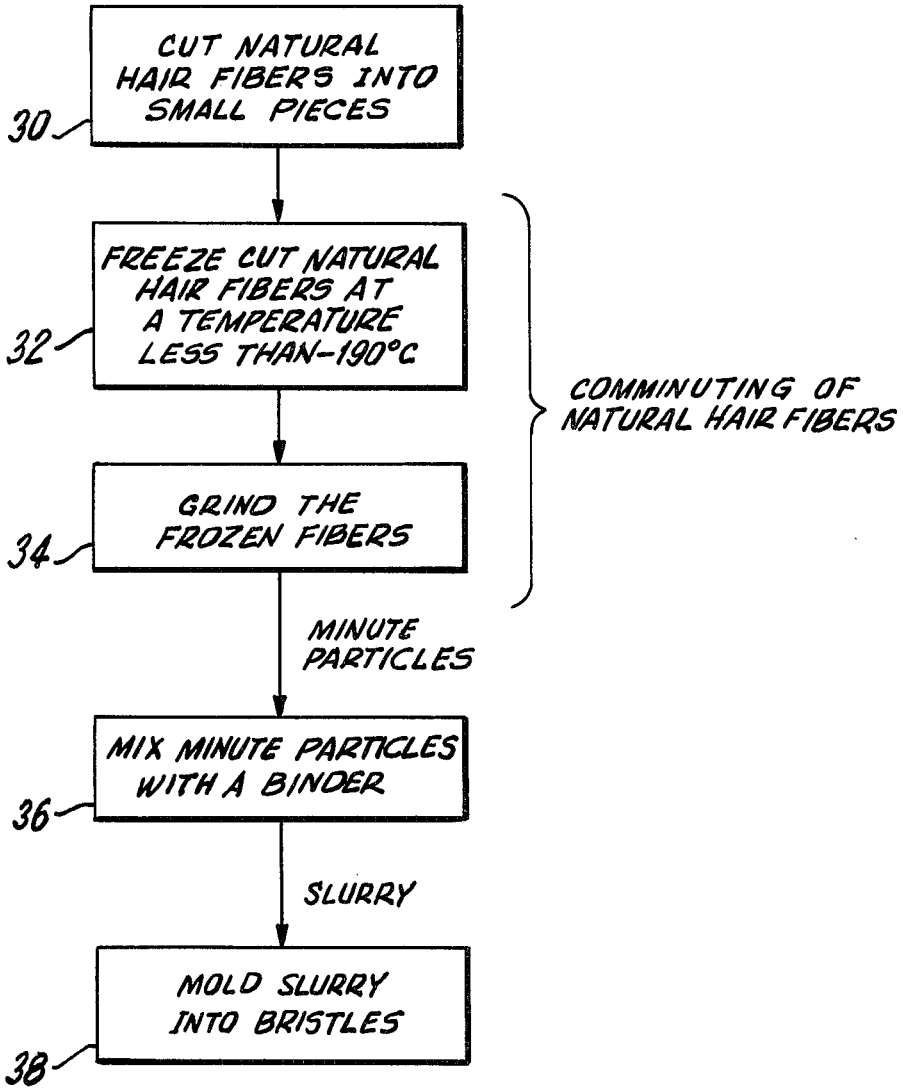
FIG. 4 is a schematic diagram in block form illustrating the steps of the process of the invention.

In accordance with this method, as illustrated schematically in FIG. 4, a quantity of human or animal hair is processed to form bristles in a manner to be described. The type of hair utilized depends on the desired coarseness of the bristle to be fabricated. That is, if very fine bristles are to be fabricated, the hair of an animal such as a hamster is suitable; for bristles of average coarseness, human hair would be used to advantage; and horsetail hairs could be used in the event a coarse bristle is desired.

These pieces of natural animal or human hair are first cleaned, preferably by being rinsed in a hexane bath for about 30 minutes, while being shaken to remove external contamination from the hair.

After being cleaned, the hair is then cut into small pieces, preferably below 1 cm., by any suitable cutting means, as indicated at 30. The cut pieces of hair are then ground or comminuted into small particles—less than 5 microns in diameter—of essentially keratin, a fibrous protein of which animal and human hair is constituted.

A presently preferred manner of comminuting or grinding the hair into those fine keratin particles is to place the pieces of hair into a container of liquid nitrogen at a temperature of between −195° and −190° C, as indicated at 32. The container may include a centrally located, movable hammer member and a pair of fixed metal members or anvils at each end. A pair of electromagnets is placed external to the container and a.c. current is supplied thereto to cause the hammer member to reciprocate into and out of engagement with the anvils for a period of about 2 minutes. As the hammer strikes against the anvils, the frozen pieces of hair are ground down to the desired particle size as indicated at 34.

Thereafter, the ground keratin particles are placed in air at room temperature for a period of about 30 minutes until they are defrosted.

The defrosted fine hair particles are then mixed with a binder material in a suitable mixing apparatus, as indicated at 36". The binder is added in the amount necessary to form a thick slurry or paste of the keratin particles and binder that has the consistency of a pudding. A suitable binder material that may be used in this process to fabricate soft hair bristles is a silicone rubber such as Dow Corning Adhesive "891". For medium bristles, a suitable binder material is a nylon or polypropylene elastomer, and to fabricate a hard bristle, a suitable binder material for use in forming the slurry is 2 part epoxy.

The binder-keratin slurry is then introduced into a mold in which are formed openings of the diameter and length of the desired bristles, as indicated at 38. Typical dimensions of these openings to form bristles is between 0.1 to 0.3 mm in diameter and 0.5 to 3 cm. in axial length. The bristles are pressure extruded in the mold and the extruded bristles are thereafter allowed to harden or cure in air at a temperature of about 60° C.

The bristles made in this manner may be used as the bristles 26 in the brush described above. Those bristles are substantially static-free and resistant to breakage or splitting, as is desired. As such, they have the major benefit of natural hair bristles without the major disadvantage of such bristles.

Thus, in the hair brush of the invention, natural-type bristles are employed which will not break off when the brush is used. The use of these bristles in the brush provides the advantages of natural bristle brushes such as the elimination of static electricity and the gentle action of a natural rounded tip natural bristle, without the formation of the natural bristles into clumps or bunches, which have the tendency to remove the user's hair, as has previously been considered necessary to avoid breakage of the natural bristles.

It will be appreciated that although the invention has been hereinabove specifically described with respect to a single embodiment thereof, modifications and variations may be made therein, all without departing from the spirit and scope of the invention.

What is claimed is:

1. A method for fabricating natural-like hair bristles for use in a hair brush or the like, said process comprising the steps of comminuting a quantity of natural hair fibers into a plurality of minute particles said comminuting including the steps of freezing said hair fibers to a temperature less than −190° C, and thereafter grinding said frozen hair fibers, mixing said minute particles with a binder to form a thick slurry, and thereafter molding said slurry into bristles of a predetermined size.

2. The method of claim 1 wherein said molding includes extruding said slurry.

3. The method of claim 1, in which said binder is a substance in the group consisting of silicone rubber, a nylon elastomer, a polypropylene elastomer, and an epoxy.

4. The method of claim 1, in which said binder is a substance in the group consisting of silicone rubber, a nylon elastomer, a polypropylene elastomer, and an epoxy.

5. The method of claim 1, in which said minute particles are less than five microns in diameter.

6. The method of claim 5, which further includes the step, prior to said step of comminuting, of cutting said fibers to a size of less than 1 cm.

7. The method of claim 1, in which said hair fibers are frozen and thereafter ground in a liquid nitrogen atmosphere.

8. The method of claim 7, in which said binder is a substance in the group consisting of silicone rubber, a nylon elastomer, a polypropylene elastomer, and an epoxy.

9. The process of claim 1, in which said comminuting step includes the steps of freezing said hair fibers to a temperature less than −190° C, and thereafter grinding said frozen hair fibers.

10. The method of claim 9, in which said hair fibers are frozen and thereafter ground in a liquid nitrogen atmosphere.

11. The method of claim 1, in which said molding step includes the step of extruding said bristles in a mold.

* * * * *